United States Patent [19]

Gerhard

[11] Patent Number: 4,614,278

[45] Date of Patent: Sep. 30, 1986

[54] TANK CONTAINER

[75] Inventor: Helmut Gerhard, Weitefeld, Fed. Rep. of Germany

[73] Assignee: Westerwaelder Eisenwerk Gerhard GmbH, Weitefeld, Fed. Rep. of Germany

[21] Appl. No.: 678,794

[22] Filed: Dec. 6, 1984

[30] Foreign Application Priority Data

Dec. 8, 1983 [DE] Fed. Rep. of Germany ... 8335251[U]

[51] Int. Cl.[4] ..... B65D 19/28; B65D 88/12

[52] U.S. Cl. ..... 220/1.5; 108/51.1; 108/55.1; 220/5 A; 220/72.1; 220/401; 410/68; 410/121

[58] Field of Search ..... 220/1.5, 5 A, 401, 71, 220/72.1, 70.1, 18.1; 410/153, 155, 143, 144, 121, 70, 68; 296/181, 182, 196; 105/439, 382, 411, 407; 108/51.1, 55.1

[56] References Cited

U.S. PATENT DOCUMENTS

| | | | |
|---|---|---|---|
| 1,411,349 | 4/1922 | Hamilton | 105/411 |
| 2,817,305 | 12/1957 | Stough | 410/144 |
| 3,386,600 | 6/1968 | Betjemann | 220/1.5 |
| 3,459,326 | 8/1969 | Betjemann | 220/1.5 |
| 3,620,388 | 11/1971 | Mansson | 206/509 X |
| 4,046,278 | 9/1977 | Chieger et al. | 220/1.5 |
| 4,108,326 | 8/1978 | Bertolini | 220/1.5 |
| 4,307,812 | 12/1981 | Gerhard | 220/5 A X |

*Primary Examiner*—Allan N. Shoap
*Attorney, Agent, or Firm*—Barnes & Thornburg

[57] ABSTRACT

A frame structure for a tank container comprises two end frames 10 and two side protection assemblies mounted between corner support elements 11 of the end frames 10. Each side protection assembly is formed by a bottom longitudinal beam 21 and a fender beam 22 disposed above the bottom beam 21 and connected thereto by a plurality of vertical struts 24. Each side protection assembly is detachably connected to the respective pair of vertical corner support elements 11 so that it may be removed, dressed or replaced by a new assembly and again mounted in place in case it has become damaged. Fixation of the side protection assemblies to the corner support elements 11 is done by means of triangular fixing members 30 welded to the corner support elements 11. Each fixing member 30 includes a horizontally extending support arm 31 which extends parallel to and backs end portions of the bottom horizontal beams 21 which are thus available for engagement by container handling devices.

9 Claims, 2 Drawing Figures

Figure 1:
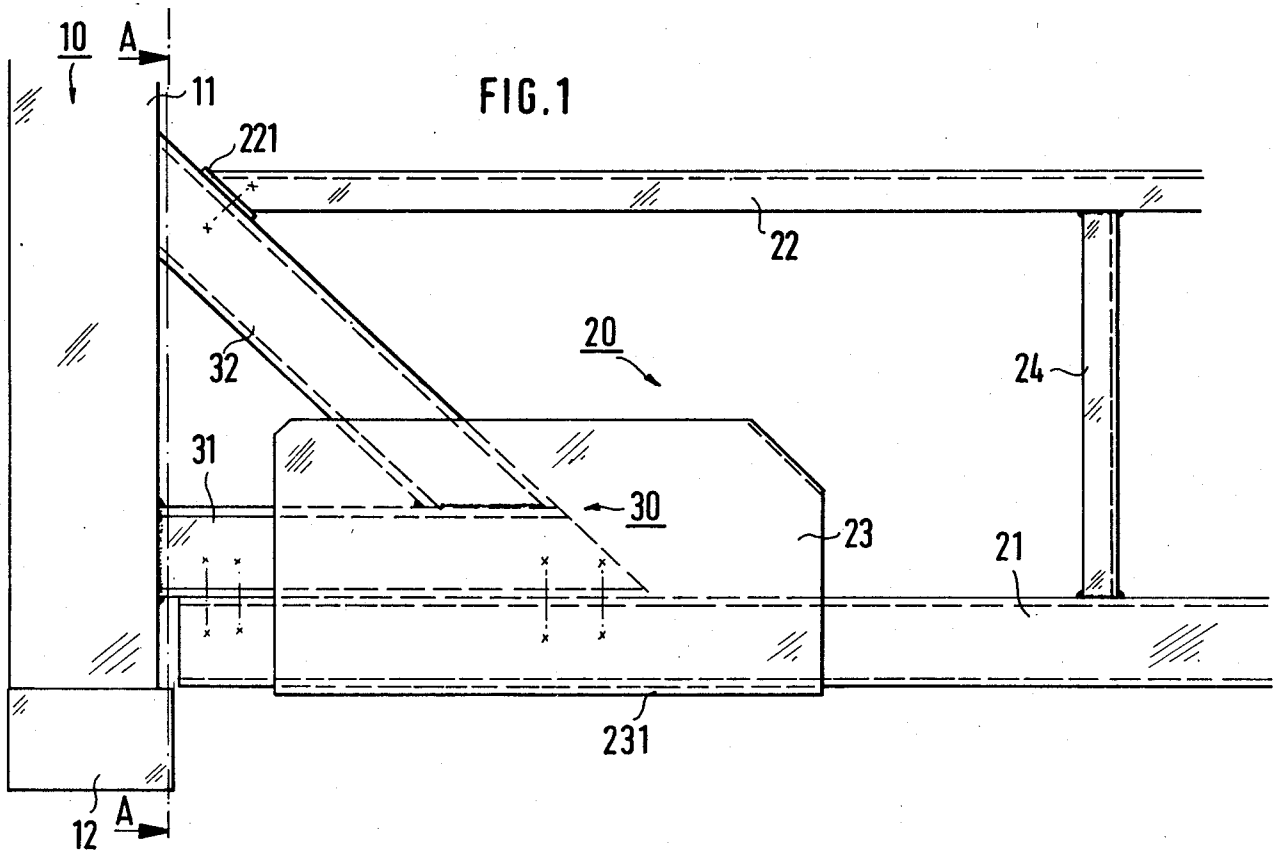

10
11
221
A
A
12
20
22
24
21
23
30
231
32
31

TANK CONTAINER

The invention relates to a tank container, specifically of the type which comprises a frame structure with end frames and side protection assemblies on either of the longitudinal sides, including a bottom longitudinal beam and a fender beam disposed thereabove.

A tank container frame structure is known from the British Patent Specification No. 1,225,325, in which lateral longitudinal beams are permanently joined by welding to the end frames. However, such longitudinal beams of containers are frequently damaged by rough transhipment handling, e.g. with gantry-cranes and fork-lift trucks. In that case, bent longitudinal beams can be either hot-dressed, wherein considerable damage to the tank or to the insulating sheath of the container itself must be tolerated, or they have to be cut out with flame cutters, exchanged or dressed and again welded in position.

The removal of re-usable sectional elements of flame cutting, however, considerably deteriorates the mechanical properties of the material on re-use. Moreover, the respective repair welds normally have to be performed in fixed position and do not satisfy the strength characteristics of production welds which are performed in gravity position during regular production on welding jigs.

When the longitudinal beam after repair is painted in dissembled state, the welds produced during reassembly in the container frame require fresh descaling, cleaning, derusting and painting, whereby normally the quality of the coating is deteriorated. In permanently welded structures such defects in the coat of paint frequently occur on the side of the frame sections facing the tank.

In the hitherto known bolted container frames, which are sometimes used, both the bottom longitudinal beams and the screw joints are of extremely heavy structure, because they have to absorb the considerable horizontal forces produced in operation and to transfer the same from the lower corner fittings of one container end face to those of the other end face. This constitutes a drawback in respect of both weight and costs.

It is therefore advantageous to design the tank and the frame structure such that the horizontal acceleration forces occurring in the bottom assembly are directly introduced via diagonal braces into the tank and may be absorbed thereby. A container structure in accordance with this "beam concept", as it is called, without a continuous bottom assembly is described, for instance, in the DE-PS No. 2,828,349.

However, due to the complete elimination of bottom longitudinal beams the protection of the lower container half against mechanical damage during transport is reduced. The same applies to the belt region of the tank, which is especially susceptible to damage in case of lateral collisions. Practical experience accumulated over many years has shown that repairs of any damage to the thermal insulation of the tank and to the sheath thereof occurring at the side of the tank are extremely expensive.

It is thus an object of the instant invention to eliminate the drawbacks existing in the prior art and to protect a tank container on either of its longitudinal sides from lateral damage which may occur either during transport or in transhipment. Such a side protection assembly should be adapted, after having suffered deformation, to be dressed and again made corrosionresistant in an inexpensive and yet technically correct way without any flame, cutting and welding operations and without any damage to the tank or the insulating sheath thereof.

Moreover, said side protection assembly should have a low dead weight so that, especially in combination with a beam tank, a tank container of low overall weight is provided.

At the same time it should be possible to integrate in such a side protection structure the standard recesses for handling of the container with stock-yard cranes in inland terminals (ISO 1496/III, appendix D and UIC Regulations).

To meet with the above objects, the tank container of the present invention comprises a tank, two end frames joined to the tank in self-supporting fashion, each end frame having a pair of vertical corner support members, and two side protection assemblies each including a bottom longitudinal beam and a fender beam disposed thereabove, each side protection assembly being detachably secured to the corner support members of both end frames.

In a preferred embodiment fixing members for said side protection assembly consist of a support arm projecting in longitudinal direction of the container, and of a brace which extends obliquely upwardly from the end of the support arm and is fixedly joined to the corner support. The bottom longitudinal beam of the side protection assembly is removably joined to the support arm, and the fender beam is removably joined to the oblique brace.

The dead weight of such a side protection assembly may be kept low, because there are practically no horizontally acting compressive and buckling forces to be accommodated. Furthermore, it is possible to dismount the side protection assembly with few manipulations, and any damaged portion may be dressed, freshly sandblasted and painted on all sides like a new-value part without any deterioration of the surface quality of the tank or its insulation.

In another embodiment, the fixing members are shaped such that the bottom edge of the bottom longitudinal beam secured to the support arm extends substantially at the level of the upper edge of lower corner fittings provided on the end frames. From the viewpoint of production engineering the folding in the lower region of the guide plates is especially advantageous, because welding of special square sections is then unnecessary. The two guide plates in each side protection assembly provide for guide strips in the region of the zones for handling as required by the Standard and also for the necessary sliding surfaces which prevent improper hooking of the grapplers in the container frame during transhipment.

In a further embodiment, the guide plates cooperate with the fixing members to fix the side protection assemblies in transverse direction relative to the tank.

Preferably, the bottom longitudinal beam and the fender beam of the tank are interconnected by struts and thus form a unitary side group.

The features of the invention facilitate the mounting of the side protection structures, i.e., securing thereof to the fixing elements which are connected to the end frames, because the entire side protection assembly is fixed relative to the tank container both in vertical and longitudinal direction and in transverse direction.

Figure 2:
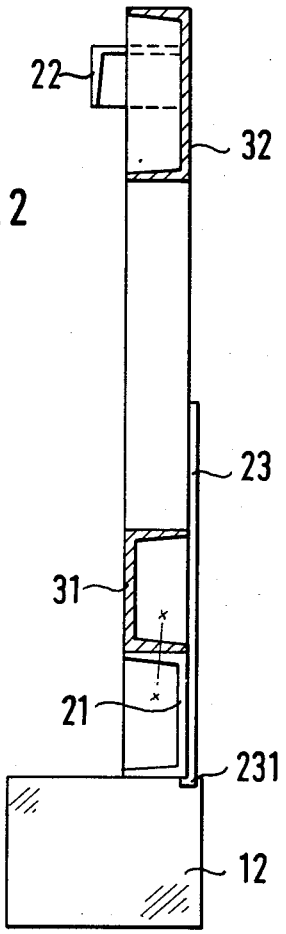

Below, a preferred embodiment of the invention will be explained in detail with reference to the drawing, in which FIG. 1 is a side view of a region of a tank container having recesses for handling, and FIG. 2 is a somewhat enlarged cross-section along the line "A—A" in FIG. 1.

FIG. 1 illustrates a container end frame 10 including a vertical corner support 11 and a lower corner fitting 12, a fixing member 30 and the side protection assembly 20 which is detachably joined to said fixing member.

The side protection assembly 20 comprises a lower longitudinal beam 21 and an additional fender beam 22 below the belt line of the cylindrical tank. One or several connecting struts 24 extending along the length of the container are provided between these longitudinal elements to reinforce the detachable side protection assembly 20. The connecting struts may be vertical sectional struts as illustrated in FIG. 1, or they may be diagonal struts intersecting at the fender beam 22 approximately in the centre of the container.

Externally extending guide plates 23 for grapplers having minimum external dimensions of $600\times300$ mm$^2$ are provided on the lower longitudinal beam 21 in the regions of container handling zones as determined by ISO-Standard 1496/I, Appendix D. These guide plates 23 are inwardly folded along their lower side by 12 mm, and the folded portions 231 engage the respective bottom longitudinal beams 21 and are sufficiently welded thereto. They serve both as sliding surface and also as lateral stop means and guide strip for the grapplers.

The fixing elements 30 formed of the support arm 31 and the brace 32 are employed to join the side assemblies 20 to the container end frame 10. The support arm 31 is a sectional arm which projects in longitudinal direction of the container and is welded to the corner support at right angles. For reinforcing purposes this projecting arm 31 is diagonally supported by means of a brace 32 relative to the vertical corner support 11. The diagonal brace 32 extends preferably at an angle of 45° to the corner support and is configured as a sectional element. It may also be configured together with the support arm 31 as an integral gusset plate.

As illustrated in FIG. 2, the support arm 31 and the lower longitudinal beam 21 are configured as similar C-sections (NPU $100\times100\times50\times6$) in this embodiment. In the region of the handling zones, the profile of the lower longitudinal beam 21 may be reinforced by means of some vertical webs to withstand the loads applied thereto. In the described embodiment the fender beam 22 consists of an open-bottomed C-section beam of the same or smaller dimensions as the bottom longitudinal beam 21.

Bolts of required cross-section join the top flange of the bottom longitudinal beam 21 to the bottom flange of the support arm 31 welded to the corner support, and join the fender beam 22 to the inclined diagonal corner brace 32 by means of a flange 221 extending in parallel thereto. The support arm 31 is welded to the corner support 11 in such a way that the bottom longitudinal beam 21, which is secured thereto, extends with its bottom edge at the level of the top edge of the lower corner fittings 12, i.e., at the level of the handling zones.

As will be apparent from FIG. 2, the C-sections of the support arm 31 and of the bottom longitudinal beam 21 are packed in superposed relationship in such a way that the support arm 31 opens outwardly and the bottom longitudinal beam 21 opens inwardly. By this arrangement the mechanical strength of the packed sectional arms is increased, and passage of the required connecting bolts is facilitated. Moreover, a large bearing surface results for the guide plate 23 to be mounted to the bottom longitudinal beam 21, when the latter is closed to the outside.

The side protection assembly 20 may be mounted as described with little expenditure, as the assembly 20 is fixed relative to the container frame and the fixing elements 30, respectively, in vertical direction by means of the longitudinal beam 21 which extends beneath the support arms 31 and engages the same, and in transverse direction by means of the guide plates 23 welded to the bottom longitudinal beam 21, and in longitudinal direction by means of the flanges 221 engaging the inclined corner supports 32. The fixing elements 30 and the bottom longitudinal beam 21 should be designed so that the operational load acting on each of the four handling zones may be accommodated and converted. According to ISO the operational load acting on each handling zone is calculated as follows:

$$1.25\times R:4 \text{ (R = overall weight).}$$

When the frame structure is used in conjunction with a beam tank, the longitudinal forces created during operation are directly introduced into the tank so that they need not be transferred from the bottom longitudinal beams 21. However, for safety reasons the longitudinal beams 21 are designed such that they may also accommodate horizontal longitudinal forces of residual magnitude.

I claim:

1. A tank container arrangement comprising:

a tank means;

two end frame means joined to the respective opposite ends of said tank means, each of said end frame means including vertical support means for forming together with said tank means a self-supporting tank container structure;

fixing members provided on the vertical support means, including support arm means fixably joined at a first end to the respective vertical support means and projecting in a longitudinal direction of said tank container, and inclined brace means extending obliquely upwardly from a second end of said support arm means and being fixably joined to said vertical support means; and side protection assembly means detachably secured between the respective said end frame means for protecting a portion of said tank means therebetween, wherein said side protection assembly means includes respective lower and upper longitudinal beam means disposed between said end frame means, said lower longitudinal beam means being removably joined to said support arm means and said upper longitudinal beam means being detachably joined to said inclined brace means.

2. The tank container arrangement of claim 1, wherein said vertical support means includes a pair of vertical support members spaced laterally from one another, wherein said support arm means includes a pair of support arm members laterally spaced from one another, wherein said inclined brace means includes a pair of inclined brace members laterally spaced from one another, wherein said lower longitudinal beams means includes a pair of beam members extending in a longitudinal direction and laterally spaced from one another, and wherein said upper longitudinal beam means includes a pair of beam members extending in a longitudinal direction and laterally spaced from one another.

3. The tank container arrangement of claim 1, wherein said lower longitudinal beam means and support arm means are formed by C-section members disposed on top of each other with their respective open sides facing in opposite directions.

4. The tank container arrangement of claim 1, wherein said end frame means includes lower corner fittings and said fixing members are shaped such that a bottom edge of said lower longitudinal beam means secured to said respective support arm means extends substantially at the level of an upper edge of said lower corner fittings.

5. The tank container arrangement of claim 1, wherein each side protection assembly means includes, in a predetermined region near each end, a guide plate means mounted to said lower longitudinal beam means, said guide plate means having a lower, inwardly folded portion engaging the underside of the lower longitudinal beam means to form an area for engagement by a container handling device.

6. The tank container arrangement of claim 5, wherein said guide plate means cooperate with said fixing members to fix the side protection assembly means in transverse direction relative to the tank means.

7. The tank container arrangement of claim 1, wherein an end of said upper longitudinal beam means is provided with a flange means extending parallel to said inclined brace means.

8. The tank container arrangement of claim 7, wherein said flange means provided on said upper longitudinal beam means cooperate with said inclined brace means to fix the side protection assembly means in vertical and longitudinal direction relative to the tank means.

9. The tank container arrangement of claim 1, wherein said lower longitudinal beam means and said upper longitudinal beam means are joined to each other by means of struts.

* * * * *